United States Patent [19]

Seibert

[11] 4,380,879

[45] Apr. 26, 1983

[54] MATRIX DISPLAY

[75] Inventor: Lloyd Seibert, Coeur d'Alene, Id.

[73] Assignee: American Sign & Indicator Corporation, Spokane, Wash.

[21] Appl. No.: 215,359

[22] Filed: Dec. 11, 1980

[51] Int. Cl.[3] ..... G09F 3/04; G08B 5/00; G09F 3/18; G08B 23/00

[52] U.S. Cl. ..... 40/447; 40/16.4; 340/815.04; 340/815.24

[58] Field of Search ..... 40/449, 447, 450, 451, 40/452, 12, 16, 16.2, 16.4, 16.6; 340/373, 378.1, 378.2, 378.3, 378.4, 378.5, 378.6, 382; 350/275; 313/519

[56] References Cited

U.S. PATENT DOCUMENTS

| | | | |
|---|---|---|---|
| 409,340 | 8/1889 | Unz | 248/441 |
| 1,097,689 | 5/1914 | Vaughn | 340/145 |
| 1,954,069 | 4/1934 | Cole | 340/125 |
| 2,094,193 | 9/1937 | Summers | 40/16.4 |
| 2,642,685 | 6/1953 | Handley | 40/447 |
| 3,307,170 | 2/1967 | Aoyama et al. | 340/703 |
| 3,516,086 | 6/1970 | Aiken | 340/378.1 |
| 3,636,557 | 1/1972 | Watkins | 40/447 UX |
| 3,680,083 | 7/1972 | Pihl | 40/447 UX |
| 3,921,131 | 11/1975 | Buono | 340/139 |
| 3,975,728 | 8/1976 | Winrow | 340/373 |
| 3,991,496 | 11/1976 | Helwig et al. | 40/449 |
| 4,015,255 | 3/1977 | Wood | 340/373 |
| 4,040,193 | 8/1977 | Matsuda et al. | 40/449 |

*Primary Examiner*—Gene Mancene
*Assistant Examiner*—Michael J. Foycik, Jr.
*Attorney, Agent, or Firm*—Wells, St. John & Roberts

[57] ABSTRACT

A display assembly in the form of a supporting shell that mounts the assembly in an upright display panel in a matrix configuration. A disk assembly is pivoted to each shell and includes a thin disk movable about a transverse horizontal axis. The disk is moved by magnetic forces between a reflective position exposing one disk surface to the front of the panel, a closed condition exposing its opposite surface to the front of the panel, and a back-lighted condition which is intermediate the other two.

9 Claims, 17 Drawing Figures

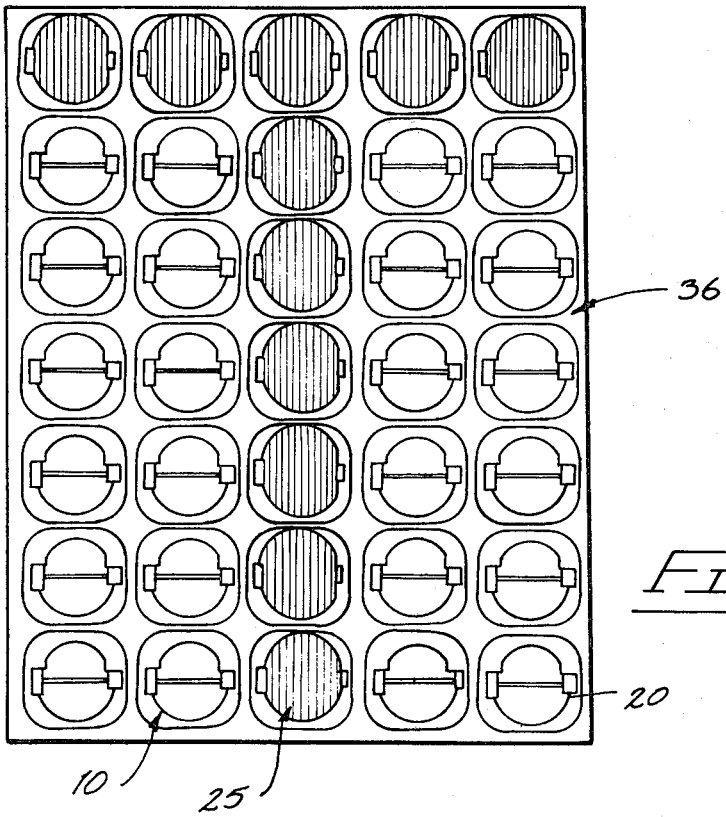
FIG 1
FIG 2
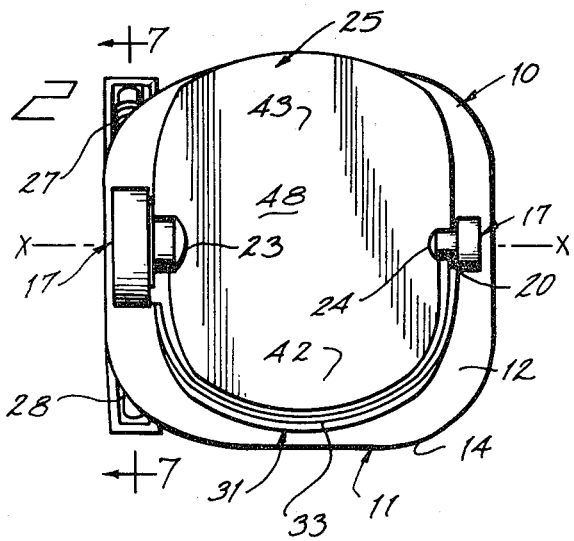

FIG 3
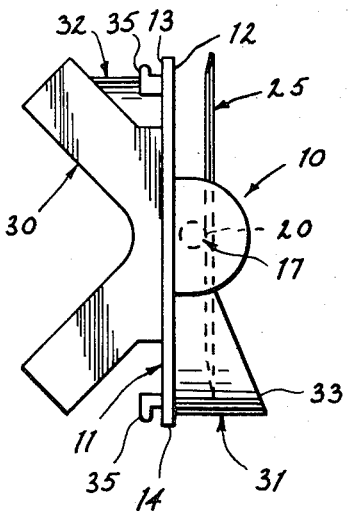
FIG 4
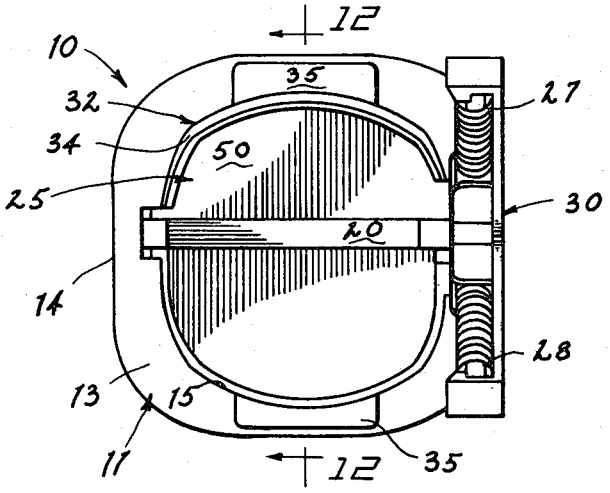
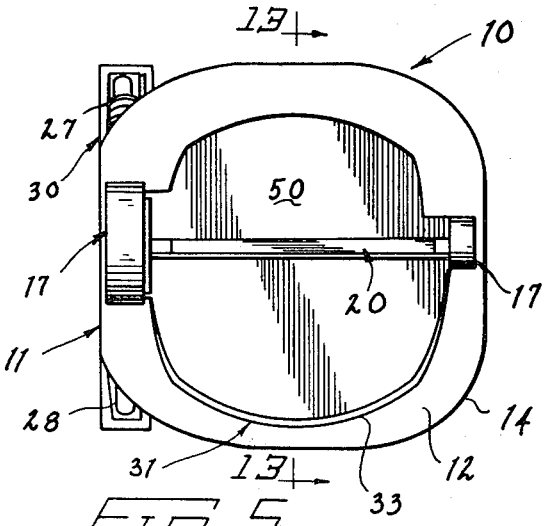
FIG 5
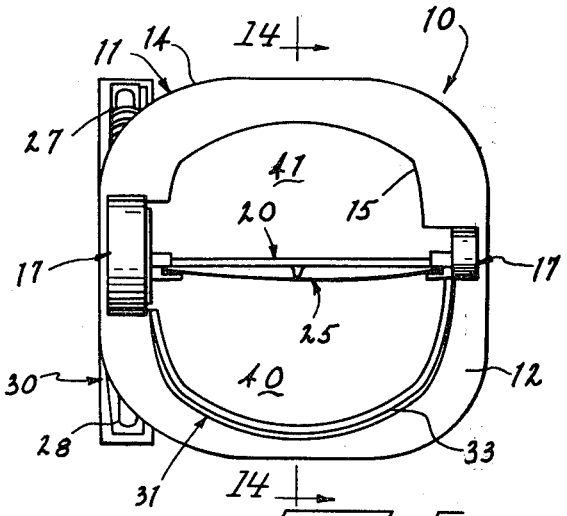
FIG 6
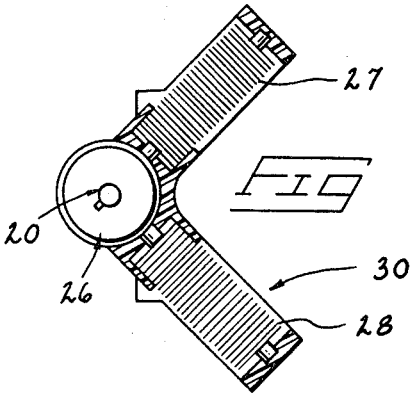
FIG 7

MATRIX DISPLAY

BACKGROUND OF THE DISCLOSURE

This relates generally to changeable displays used for portraying visual or written information by a plurality of pivotable disks movable between contrasting conditions for day or night viewing conditions. The movable display assembly itself can be used in any desired spatial arrangement. This includes pre-arranged positions where the display assemblies might be alternately used to indicate one or two or more limited words or messages. More commonly, the display assembly will be used in a rectangular or geometric matrix. In such a matrix, the individual display assemblies will be typically arranged in multiple vertical columns and horizontal rows so as to be generally usable in portraying unlimited combinations or pictorial or written information.

A typical element used today in such a display matrix is a lighted lamp. Lighted lamps are used in both daylight and darkened environments to provide a visual contrast with a dark background panel. While very effective as a visual display, large matrix displays of this type require substantial amounts of energy for operation and also generate substantial amounts of heat, most of which is typically wasted to the environment.

The present display was developed in an effort to provide an economic alternative to a lighted lamp bank or lamp matrix display. To provide visual contrast under darkened or night conditions, a backlighted panel was desired. However, backlighting does not normally provide adequate contrast in such a display when viewed under bright daylight conditions. For these reasons, a reflective daylight display was desired as well.

The present apparatus provides two modes of operation. For daylight usage or for display under relatively bright environmental lighting conditions, a reflective or fluorescent contrasting display is available in combination with the background of the panel. For nighttime use or display under darkened environmental conditions, a backlighted contrasting display is used. This versatility in display application required development of controls for moving the individual disks between three positions, each of which must be a stable rest position which can be maintained without continuous energization.

The present apparatus pivots a thin disk from a sealed background position to an opposed reflective or fluorescent position or to an intermediate light-transmitting position. In each of these alternate stable positions, the disk and its supporting elements are movable by magnetic forces to the alternate positions. This assures certainty in the disk movement and removes visual hesitancy that might otherwise affect the visual impact of an instantly changeable display. The resulting mechanical apparatus has a visual impact under all environmental lighting conditions similar to that achieved by instantly turning a multitude of lamps on or off to change a lamp bank matrix.

DESCRIPTION OF THE DRAWINGS

FIG. 1 is a front view of an assembled matrix showing display of a letter;

FIG. 2 is a front view of a single display assembly in the reflective condition;

FIG. 3 is a rear view of the display assembly in the reflective condition;

FIG. 4 is a side view of the display assembly;

FIG. 5 is a front view of a single display assembly in the closed or background condition;

FIG. 6 is a front view of a single display assembly in the backlighted condition;

FIG. 7 is a fragmentary sectional view taken along line 7—7 in FIG. 3;

DESCRIPTION OF A PREFERRED EMBODIMENT

The drawings illustrate a specific form of the invention, which is an individual movable display assembly. It is adapted to be arranged in a spatial display arrangement forming discrete informational patterns or in a matrix having multiple vertical columns and horizontal rows for display of general pictorial or written information.

Each assembly is individually controlled and movable between three different positions. In one position, the assembly displays a surface that contrasts with the background of the matrix. In the second position, it displays a surface having a color common to the background. In the third position, it transmits light from behind the assembly in a backlighted display mode. The first and second positions are designed for use in a reflective mode; the second and third for use in a backlighted mode.

Figure 15:
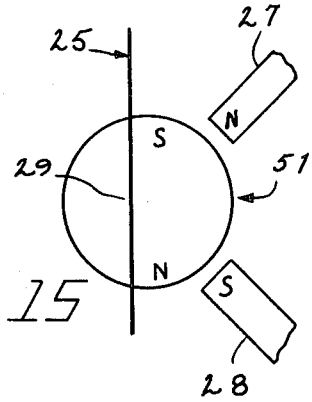
FIG. 15 is a schematic view of the display assembly in the reflective condition.
Figure 16:
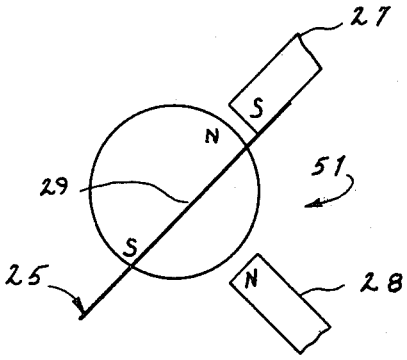
FIG. 16 is a schematic view of the display assembly in the closed condition.
Figure 17:
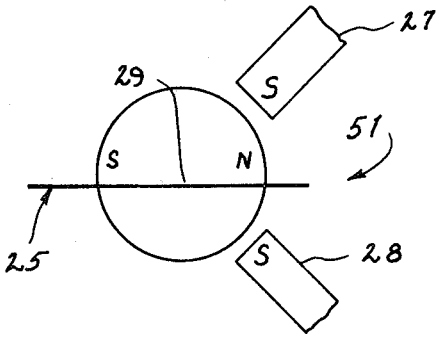
FIG. 17 is a schematic view of the display assembly in the backlighted condition.

The assembly basically comprises a shell 10 that supports the assembly components; an armature 20 and disk 25 that pivot relative to the shell as a unit; and a magnetic operator, shown as a permanent magnet 26 on the armature 20 and a pair of driving magnets 27 and 28 at the back of shell 10. By selectively reversing magnets 27 and 28, disk 25 can be instantly positioned in one of the three above-described positions. The three operational positions of the assembly are shown in sectional views 12, 13 and 14. Schematic views illustrating operation of the assembly in the three positions are shown in FIGS. 15, 16 and 17.

As shown in the drawings, shell 10 is molded of plastic resin or other suitable structural material as an integral member. Shell 10 can be integral with a supporting panel or frame for the display or can be a separably formed component as shown. It includes a surrounding rim 11 having a front surface 12 and an oppositely facing back surface 13. The surfaces 12 and 13 are bounded by an outer peripheral edge 14 and an inner peripheral edge 15. The edge 15 surrounds a centrally open window through the shell 10.

Bearing means for the armature 20 are provided integrally in the molded shell 10 and are designated in the drawings specifically at 17. The bearings 17 are shown as inwardly open apertures aligned along a transverse pivot axis X—X.

Armature 20 comprises a transverse axle 22 having offset support stubs 21 complementary in both size and location to the bearings 17. Stubs 21 are adapted to be inserted into the opposed bearing apertures to pivotally mount armature 20 about axis X—X. The offset between axle 22 and stubs 21 facilitates flexure of the armature 20 for insertion of the stubs 21 into the bearing apertures at each side of shell 10. It also facilitates overlapping of the enlarged reflective or fluorescent area of disk 25 in front of shell 10 when in the position shown in FIGS. 2, 3 and 12.

The resulting forward projection of disk 25 significantly increases the visibility of the reflective or fluorescent area on disk 25 in contrast to the more recessed position assumed in the closed disk condition. It brings disk 25 forward to minimize overlap of adjacent shell surfaces which might otherwise obscure viewing of the disk.

Figure 8:
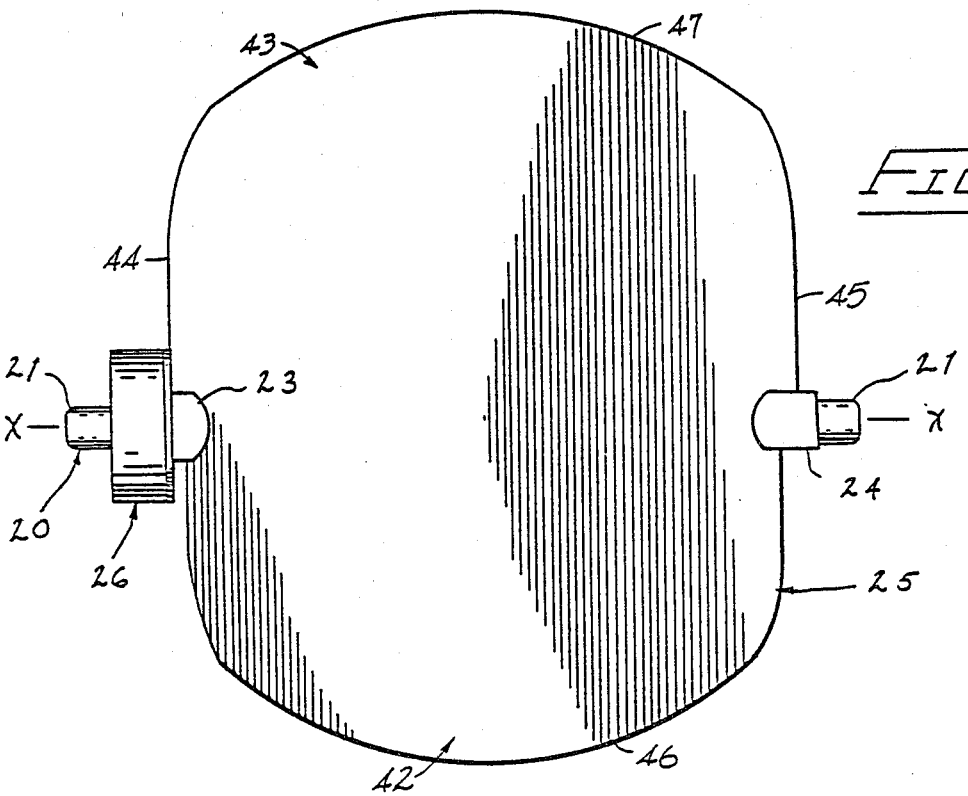
FIG. 8 is a front elevation of a disk assembly.
Figure 9:
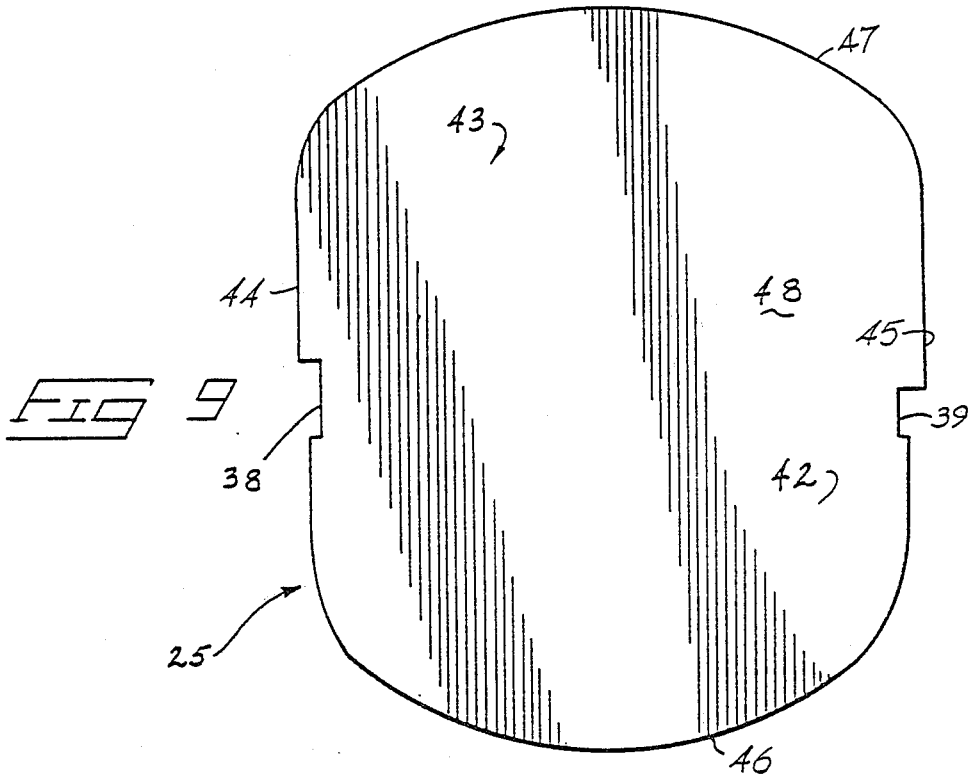
FIG. 9 is a front elevation of a disk.
Figure 10:
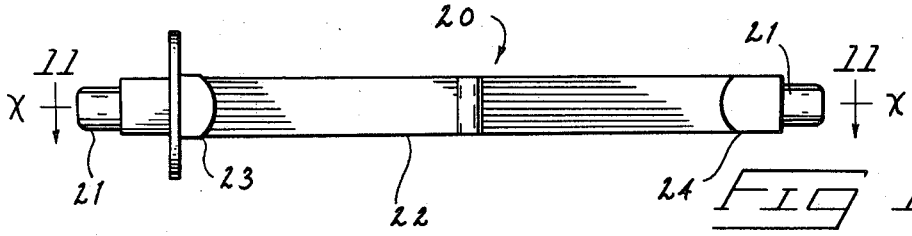
FIG. 10 is a front elevation of an armature.
Figure 11:
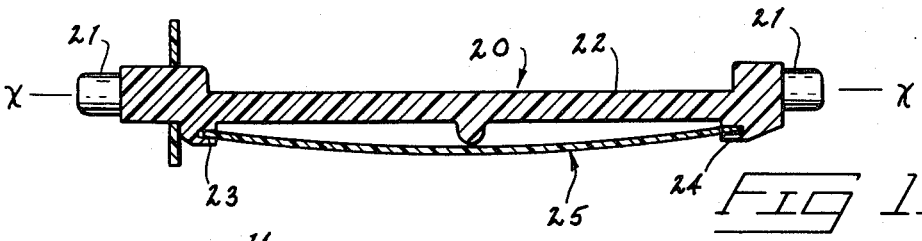
FIG. 11 is a sectional view taken along line 11—11 in FIG. 8.

Armature 20 is provided with a pair of opposed slotted tabs 23 and 24 aligned across one of its sides and partially overlapping axle 22. The tabs 23 grip the side edges of disk 25, which is provided with complementary notches 38 and 39 formed inwardly from its side edges (FIG. 9). As shown, notch 38 is complementary to tab 23 and notch 39 is complementary to tab 24. The tabs and notches are of differing width so that the interfit between them automatically indexes and locates the flap 25 properly across the armature 20.

Armature 20 also supports a cylindrical permanent magnet 26 having opposed magnetic poles located about its periphery along a plane that intersects axis X—X and is perpendicular to it. The angular position of armature 20 is controlled by switchable magnets 27 and 28 fixed to shell 10 within an integral magnet housing 30 protruding from the rear shell surface 13 (see FIG. 7). The magnets 27 and 28 have inwardly facing permanent magnet poles located adjacent to the periphery of the cylindrical magnet 26. Magnets 27 and 28 are electrically switchable by electronic controls (not shown) which reverse their polarity. A substantial amount of such polarity remains as residual magnetism without the requirement for continuous electrical current.

The shell 10 also includes complementary angular extensions 31 and 32 which limit one angular position of disk 25. The lower extension 31 projects forwardly from the front shell surface 12 about a first window section 40 located beneath axis X—X. The upper extension 32 projects rearwardly from the rear shell surface 13 about a second window section 41 located above axis X—X. Extension 31 terminates along an outer edge 33 which converges outward from axis X—X when viewed from the side. A similar outer edge 34 is formed about extension 32. As seen from the side, the two extensions 31 and 32 terminate along substantially coplanar outer edges 33 and 34, these edges being offset only by an amount equivalent to the thickness of the flap 25 which selectively contacts them.

The assembly including shell 10, armature 20, disk 25, and the magnets mounted to them, is releasably mounted to an upright support panel shown at 36, which might be in a matrix configuration and include vertical columns and horizontal rows of aligned apertures having a shape suitable to provide clearance for the moving disks 25 and for the projecting extension 32 and magnet housing 30. Panel 36 might further include printed circuitry (not shown) for connection to the terminals of magnets 27 and 28 in each assembly. Mounting projections 35 at the top and bottom of the rear shell surface 13 are engageable through complementary apertures in the panel 36 to releasably fix the shell 10 and its components to the matrix panel 36. Shell 10 and its components are removable from panel 36 as a unit for repair or replacement purposes.

As shown, the disk 25 is not symmetrical about the axis X—X. It is operationally divided into a first disk end 42 and a second disk end 43 extending oppositely from armature 20 and pivot axis X—X. The disk ends 42 and 43 are bounded on their sides by substantially parallel convex edges 44 and 45 which diminish in width outwardly from axis X—X. They intersect convex end edges 46 and 47 which are symmetrical across the width of disk 25.

It is to be noted that the first disk end 42 has a cross-sectional configuration complementary to and capable of passing through the first window section 40 on shell when pivoted about axis X—X. Also, the cross-sectional configuration of the first disk end 42 is greater in both length and width than that of the second window section 41 of shell 10. The second disk end 43 has a cross-sectional configuration greater than that of the first disk end. Its length is such as to extend outwardly to the peripheral edge 14 of shell 10 when in the reflective or fluorescent position shown in FIGS. 1 and 2.

Figure 12:
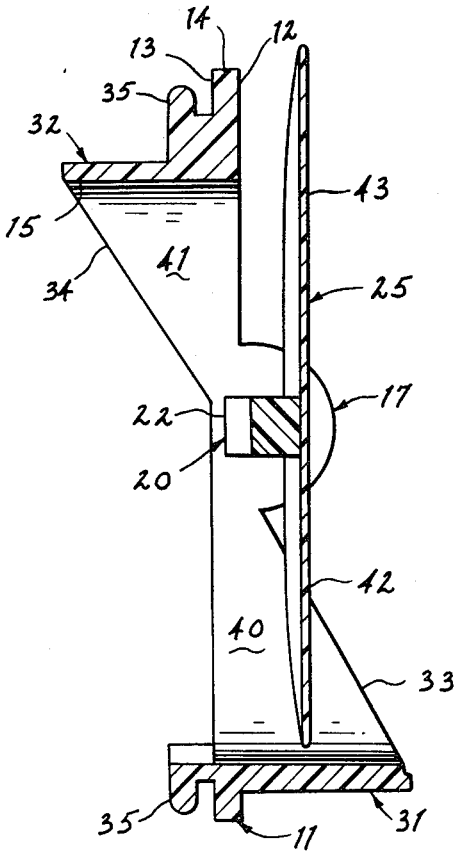
FIG. 12 is a vertical sectional view taken along line 12—12 in FIG. 2.
Figure 13:
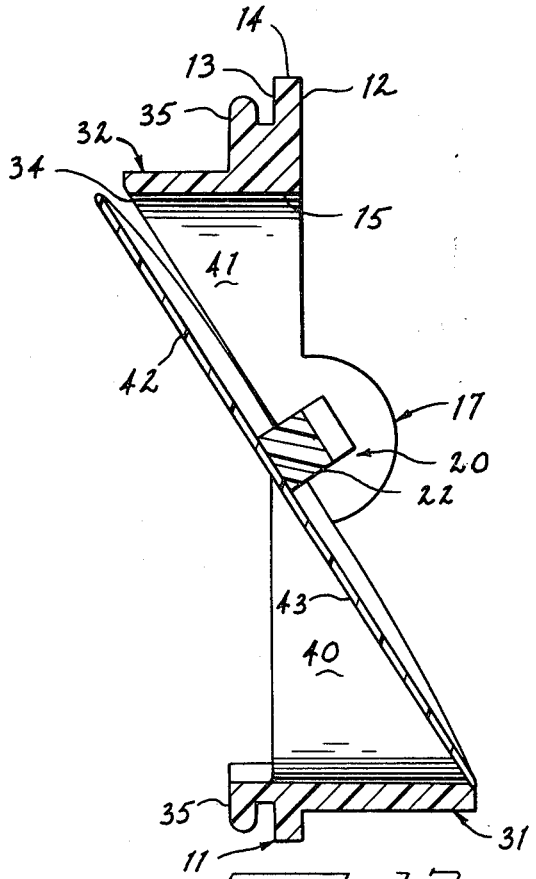
FIG. 13 is a vertical sectional view taken along line 13—13 in FIG. 5.
Figure 14:
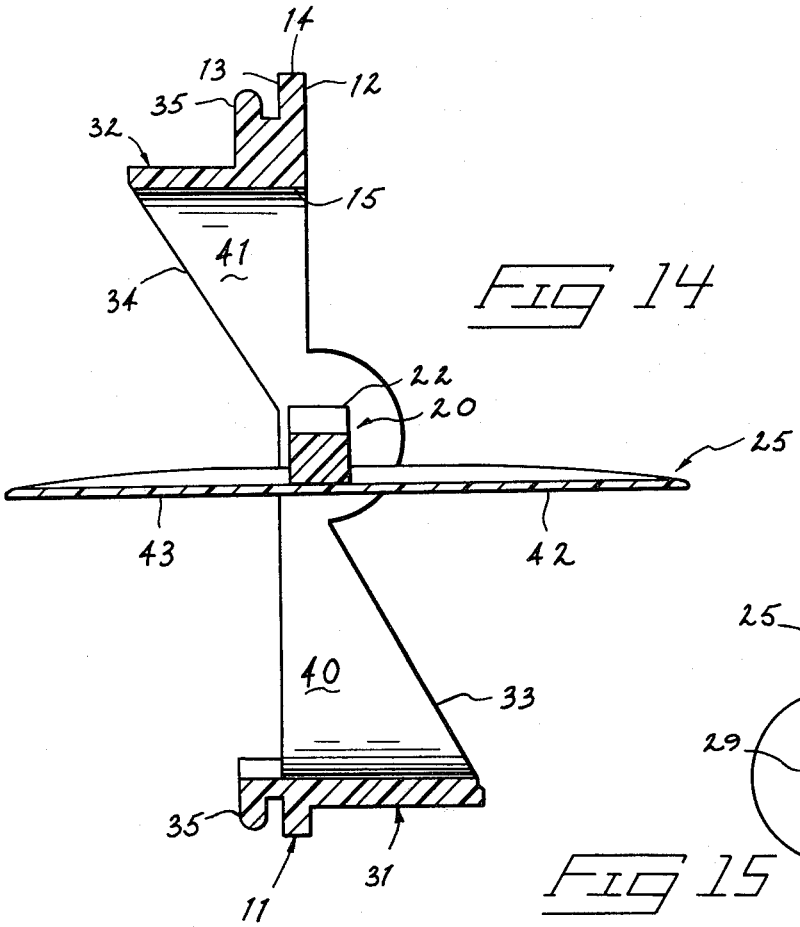
FIG. 14 is a vertical sectional view taken along line 14—14 in FIG. 6.

The operational positions of disk 25 are best understood from FIG. 12, which shows the reflective disk position, FIG. 13, which shows the background or closed disk position and FIG. 14 which shows the light transmitting disk position. During normal use of the sign under daylight conditions or where external lighting is adequate to provide substantial contrast to the flat surfaces, only the reflective or fluorescent position (FIG. 2) and the background position (FIG. 5) would be used. In darkened environments and in night conditions outdoors, only the background position (FIG. 5) and the light transmitting position (FIG. 6) would be used.

Disk 25 has visually contrasting outer surfaces 48 and 50 at opposite sides thereof. Surface 48 shall be termed a "reflective" surface and surface 50 shall be termed a "background" surface. Surface 48 can be covered or coated with any material or coloring that visually contrasts with the background color of shell 10 and panel 36. Flourescent coatings have been preferred for maximum visibility under both natural and artificial lighting conditions. Normally surface 50 and armature 20 will be painted or colored identically to the finish of shell 10 and the exposed portions of panel 36 so as to fade into the background of the display when viewed from the front. This background color is preferably black, but other colors can be utilized where desired. Surface 50 is overlapped by armature 20, but since they are identically colored, this is not visually objectionable.

It is noted that surface 48 faces outwardly opposite to the armature 20. Since it overlaps armature 20, it is unobstructed other than by the small area overlapped at each of its sides by the inwardly projecting mounting tabs 23 and 24.

FIGS. 15, 16 and 17 illustrate the alignment of the magnetic poles on permanent magnet 26 with respect to the plane of disk 25. The magnets 27 and 28 continuously maintain disk 25 in each of its three alternate preset positions until they are reactivated to move it to another position. No mechanical latches or dampeners are included in the assembly.

The reflective position (FIGS. 2 and 3) exposes most of the area about surface 48 to the front of the assembly to provide maximum visual contrast with the background elements about the matrix panel 36. In this position, disk 25 assumes an upright position exposing surface 48 to the front of the assembly. The first disk end 42 is located within the first window section 40 of shell 10 and the second disk ends 43 overlaps the front surface 12 of shell 10 about the second section 41. The only portions of the reflective or fluorescent surface 48 not visible are those overlapped by the tabs 23 and 24. The maximum available area on disk 25 is exposed for visual impact in existing light.

In the second or background position (FIG. 5), the disk 25 is rotated approximately 150° from the first position and rests with its edges against the edges 33 and 34 of extensions 31 and 32, respectively. This exposes the background surface 50 to the front of shell 10. The second disk end 43 overlaps and seals the outer edges 33 of the lower extension 31 about the first window section 40 of the shell 10. The first disk end 42 overlaps and seals the outer edges 34 of the upper extension 32 about the second window section 40. While less of the disk 25 is thereby visible when viewed from the front, this is of no material consequence since the surface 50 is colored identically to the surfaces about shell 10 and the surrounding panel 36. Disk 25 becomes part of the matrix background in this position. When the display is backlighted, disk 25 substantially stops passage of light in this position.

Transmittal of light through shell 10 is accomplished by selectively moving disk 25 to an intermediate position (FIG. 6) between the two above-described positions. In this position, disk 25 will normally be almost horizontal, although it is preferable that the forward edge of disk 25 be inclined downwardly where the display is elevated and is to be viewed from a somewhat lower location.

The assembly can be backlighted by incandescent or fluorescent tubes or by any other source of light located rearward of the assemblies as diagrammatically shown at 51 in FIGS. 15–17. In this position, it is desirable that the thin disk 25 be viewed on edge so as to obscure as little of the transmitted light as possible. In addition, interior surfaces viewable behind the panel 36 might be colored so as to contrast with the background coloring of the panel 36 and shell 10 when disk 25 is in this intermediate position.

With the disk 25 substantially aligned parallel to the magnetic poles on permanent magnet 26, armature 20 is moved to the first position by driving the magnets to polarities opposed to the permanent magnet poles when disk 25 is upright. Movement of disk 25 to its background position is achieved by reversing the polarity of the magnets 27 and 28. The intermediate position of disk 25 is achieved in alternation with the background position by reversing the polarity of one magnet 27 or 28 only, using the other as a magnetic dampener to minimize fluttering of the disk 25 as it reaches the intermediate position.

The magnets 27 and 28 are arranged at approximately 45° orientations with respect to the upright position of disk 25 and the front and rear surfaces 12 and 13 of shell 10. They are also arranged at 45° from the horizontal and 90° from one another. Their magnetic axes converge and intersect at axis X—X. The 45° orientation of magnets 27 and 28 assures substantially horizontal positioning of disk 25 when in its intermediate position. The actual position of disk 25 in any of its three positions is a resultant of the magnetic moments exerted on the armature 20.

The above display assembly provides maximum areal contrast between the reflective and background conditions for daylight or frontlighted use and between the backlighted and background positions for nighttime use or in darkened environments. The operation of the display required little energy, since the controlling magnets need only to be energized during resetting of individual disks 25. In many instances, no external lighting will be required during daylight hours. The backlighting necessary in darkened environments requires substantially less energy than is the case with conventional lamp banks used in prior matrix displays.

The assembly is designed for simplified replacement of disks 25 to compensate for fading or aging of the reflective finish on its surface 48. Each disk 25 can be readily flexed inward toward its transverse center to release it from the armature tabs 23 and 24. Similarly, the entire armature assembly can also be released from shell 10 by flexing axle 22 and pulling stubs 21 from bearings 17. Replacement of a disk or armature is no more difficult than replacement of a lamp bulb in a lighted lamp matrix.

Various modifications might be made with respect to the details of the assembly without deviating from the general features described above.

What is claimed is:

1. A movable display assembly adapted for use in a spatial arrangement that includes a plurality of individually controlled assemblies, said display assembly comprising:

an upright frame surrounding an open window;

bearing means at opposite sides of the window on said frame along a transverse bearing axis;

an armature pivotally mounted by said bearing means for angular movement relative to said frame about the bearing axis;

a thin disk fixed to said armature, said disk having visually contrasting outer surfaces at opposite sides thereof;

and means on said frame and armature for pivoting the armature and disk about the bearing axis between two or more alternate angular positions relative to the frame;

said disk being removably mounted on said armature to one side of said armature axis by a pair of opposed slotted tabs releasably engaging opposite side edges of the disk, said tabs being in alignment with one another to one side of said armature axis;

one tab being wider than the other;

said disk having notches along opposed side edges thereof complementary in width to the respective tabs, whereby the disk is properly indexed on the armature by matching of the respective notches and tabs.

2. A movable display assembly as set out in claim 1 wherein the disk is releasably gripped at its opposite side edges by a pair of opposed slotted tabs aligned along one side of said armature, one of the outer surfaces of the disk being unobstructed by said armature.

3. A movable display assembly as set out in claim 1 wherein the disk is releasably gripped at its opposite side edges by a pair of opposed slotted tabs aligned along one side of said armature, one of the outer surfaces of the disk being unobstructed by said armature;

the remaining outer surface of the disk, as well as the armature and frame all having a common background color about their areal surfaces.

4. A movable display assembly as set out in claim 1 wherein the disk is releasably gripped at its opposite side edges by a pair of opposed slotted tabs aligned along one side of said armature, one of the outer surfaces of the disk being unobstructed by said armature;

the remaining outer surface of the disk, as well as the armature and frame all having a common background color about their areal surfaces; and light means spaced behind the frame for backlighting the disk.

5. A movable display assembly adapted for use in a spatial arrangement that includes a plurality of individually controlled assemblies, said display assembly comprising:

an upright frame surrounding an open window;

bearing means at opposite sides of the window on said frame along a transverse bearing axis;

a substantially linear armature extending between said bearing means and pivotally supported thereby for angular movement relative to said frame about the bearing axis;

a thin disk fixed to said armature, said disk having a reflective surface and a background surface which are visually contrasting at opposite sides thereof;

and means on said frame and armature for pivoting the armature and disk about the bearing axis between two or more alternate angular positions relative to the frame;

said armature having two opposed slotted tabs near its ends for releasably engaging the disk in a position offset from the transverse bearing axis; said tabs being received in notches along opposed sides of the disk leaving the remainder of the reflective surface uncovered for maximum light reflection.

6. The movable display assembly of claim 5 wherein said armature further comprises an integrally formed stub at each end for being pivotally received in the bearing means.

7. The movable display assembly of claim 6 wherein said armature further comprises means for holding a cylindrical magnet at one end.

8. The movable display assembly of claim 5 wherein said armature further comprises a projection near the center thereof on the side of the armature adjacent to the disk for producing a curvature in the disk providing greater visibility from a wide range of angles.

9. The movable display assembly of claim 5 wherein said disk is asymmetrically divided into first and second disk ends by the transverse bearing axis; said first disk end having smaller widths and lengths than the second disk end thereby allowing the disk to be easily inserted between the tabs on the armature when the first disk end is inserted first.

* * * * *